US005205629A

United States Patent [19]

Simons

[11] Patent Number: 5,205,629

[45] Date of Patent: Apr. 27, 1993

[54] MOBILE CABINET

[75] Inventor: George J. Simons, Grand Rapids, Mich.

[73] Assignee: Steelcase Inc., Grand Rapids, Mich.

[21] Appl. No.: 676,095

[22] Filed: Mar. 27, 1991

[51] Int. Cl.[5] ..... A47B 91/00

[52] U.S. Cl. ..... 312/249.9; 312/228

[58] Field of Search ..... 312/29, 250, 280, 278, 312/228, 140.1, 249.8, 249.9; 108/26

[56] References Cited

U.S. PATENT DOCUMENTS

| | | | |
|---|---|---|---|
| D. 130,079 | 10/1941 | Weller . | |
| D. 236,782 | 9/1975 | Sklaroff . | |
| 948,377 | 2/1910 | Prouty . | |
| 3,317,261 | 5/1967 | Peterson et al. . | |
| 3,356,434 | 12/1967 | Theodores . | |
| 3,702,209 | 11/1972 | Moore . | |
| 3,828,695 | 8/1974 | Skaeky | 108/26 |
| 3,983,583 | 10/1976 | Herman | 312/228 |
| 4,026,616 | 5/1977 | Kuehl . | |
| 4,318,575 | 3/1982 | Redlich . | |
| 4,337,988 | 7/1982 | Schneck . | |
| 4,555,150 | 11/1985 | Turnbull . | |
| 4,588,237 | 5/1986 | Marder . | |
| 4,674,806 | 6/1987 | Kroon et al. . | |
| 4,861,122 | 8/1989 | Newhouse et al. . | |
| 5,025,749 | 6/1991 | Sutherland | 108/101 |

FOREIGN PATENT DOCUMENTS

| | | | |
|---|---|---|---|
| 0013301 | 1/1897 | Fed. Rep. of Germany | 312/228 |
| 2557438 | 7/1985 | France | 108/26 |

*Primary Examiner*—Kenneth J. Dorner
*Assistant Examiner*—Gerald A. Anderson
*Attorney, Agent, or Firm*—Price, Heneveld, Cooper et al.

[57] ABSTRACT

A mobile cabinet is provided for office workstations and the like, and includes a recess positioned in the cabinet top to receive amenity units such as trays therein which facilitate use of and personalization of the cabinet. The cabinet further includes regularly spaced blisters along the rear edge of the top which cooperatingly locate amenity units such as upright trays to further facilitate use of and personalization of the cabinet. The cabinet also includes a laterally extending inverted step located along the bottom and rear edge of the cabinet for aesthetics. The cabinet is particularly suited for use with furniture which cooperatingly uses recessed trays, upright trays, or floor tracks, and is advantageously designed to fit mateably under the worksurface of the workstation without the removal of the amenity units.

9 Claims, 2 Drawing Sheets

MOBILE CABINET

BACKGROUND OF THE INVENTION

The present invention relates to mobile cabinets, and particularly to a mobile cabinet with a plurality of interchangeable amenities.

Cabinets are generally well known in the furniture industry. Such cabinets often include a sliding drawer adaptable to satisfy various functional needs such as retaining files or storing equipment. Further, such cabinets are often provided with casters or wheels to provide mobility across a floor surface, and are sometimes designed to be cooperatingly used with a desk or other furniture.

However, present cabinets typically have a fixed exterior configuration which can not be readily adapted to satisfy various work functions. Further, improvements are desired in the ability to personalize the cabinets, such as to adapt the cabinets for specialized tasks, and to change the cabinet's outer appearance. Thus, there is a need for increased flexibility in the functionality and personalization of cabinets.

SUMMARY OF THE INVENTION

The present invention provides a mobile cabinet that includes a recessed area in the top which cooperatingly receives a plurality of different amenity units to facilitate use and personalization of the cabinet. Some of the amenity units have an outer portion which cooperates with the recessed area to securely, yet removably locate the amenity units in the top. The amenity units are designed to accommodate different tasks, and thereby facilitate functional use of and personalization of the cabinet.

Another aspect of the present invention is a mobile cabinet that includes a locating mechanism positioned generally along the rear portion of the cabinet top to receive one of a plurality of different amenity units. The amenity units include a lower end adapted to engage the locating mechanism to securely, yet removable locate the amenity units on the top of the cabinet. The amenity units further facilitate use and personalization of the cabinet.

Another aspect of the present invention is a mobile file unit that can be positioned under a worksurface without removing the amenity unit placed on the mobile file unit.

One object of the present invention is to provide a mobile cabinet adaptable for use with various amenities to facilitate use of the cabinet and allow personalization of the cabinet.

Another object of the present invention is to provide a cabinet which can accommodate specialized tasks.

Another object of the present invention is to provide a cabinet which is easily reconfigurable, durable, and efficiently useable.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 1:
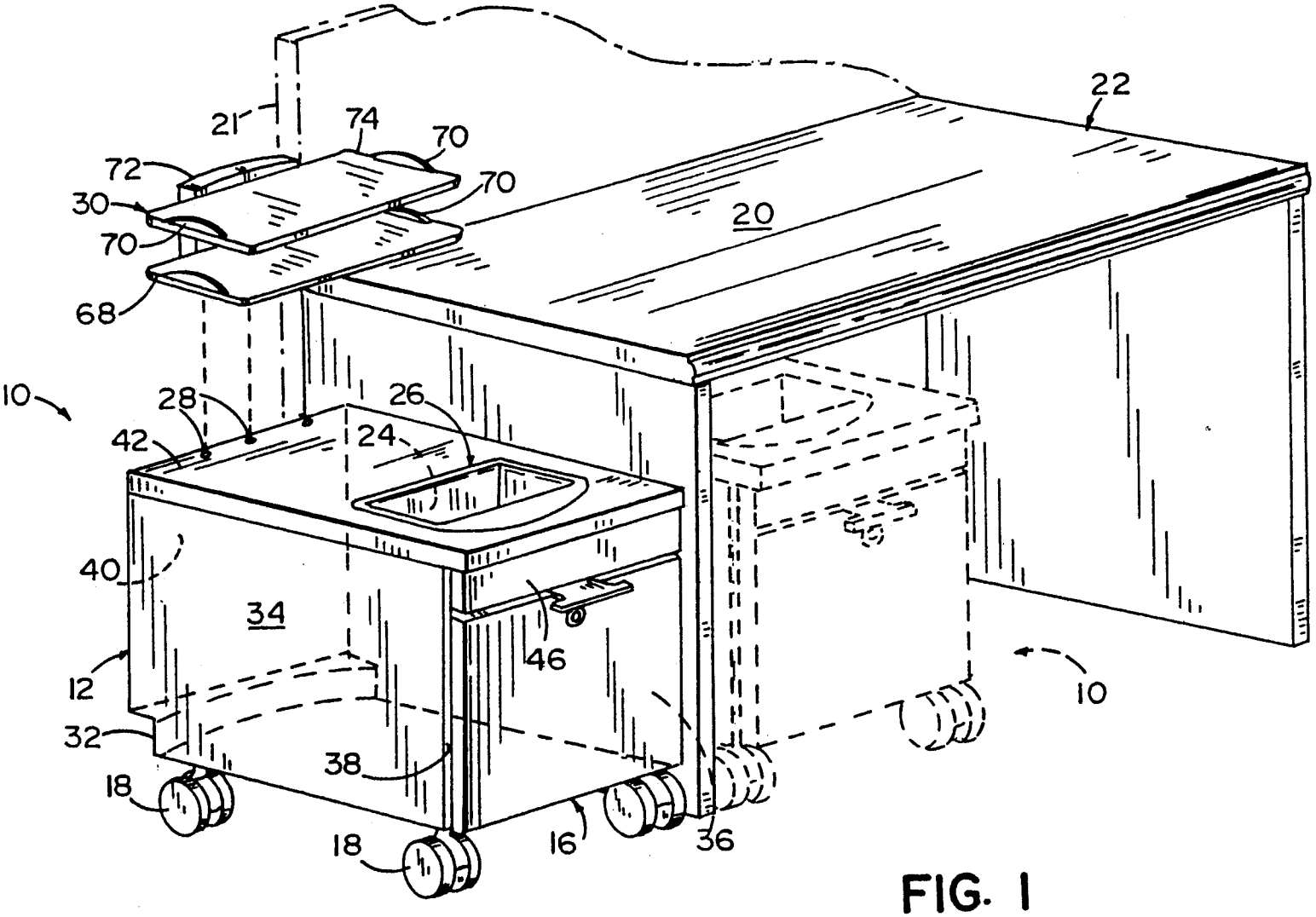
FIG. 1 is a partially exploded perspective view of a mobile cabinet embodying the present invention, the cabinet being shown adjacent a worksurface and also in phantom under the worksurface, the cabinet having a first tray shown positioned in a recess in the top of the cabinet, and further having a second tray shown exploded away from the cabinet.
Figure 2:
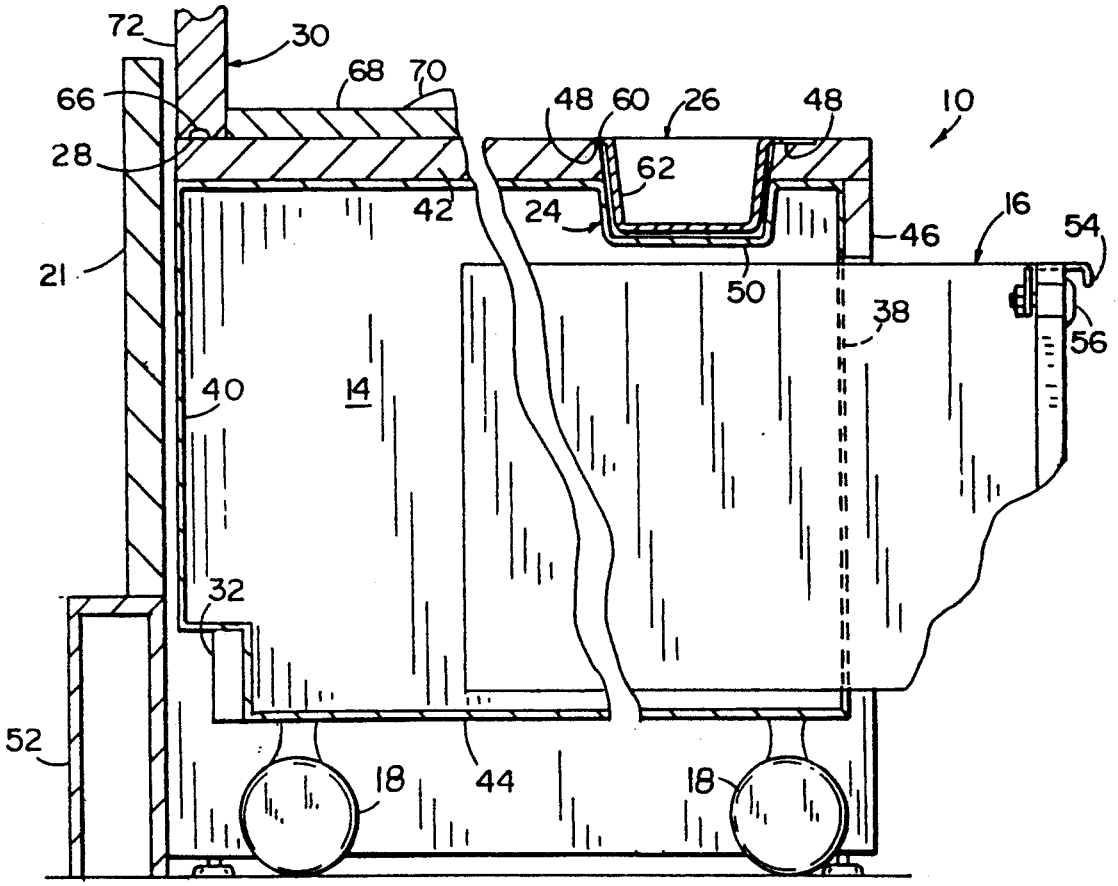
FIG. 2 is a cross-sectional side view of the cabinet illustrated in FIG. 1.

Referring now specifically to the drawings and the illustrated embodiments depicted therein, a mobile storage unit or cabinet assembly 10 embodying the present invention (FIGS. 1–2) has a box-like frame or cabinet 12 defining a hollow interior 14 which houses a drawer 16. Wheels or castors 18 are mounted to the bottom of cabinet 12 to provide mobility to mobile unit 10 and allow mobile unit 10 to be moved between a first position of use under a worksurface 20 of an associated workstation 22, and a second position of use adjacent workstation 22. Mobile unit 10 provides a recessed area 24 for supporting amenity units such as the illustrated recessed tray 26 (FIG. 1), and also provides a locating feature in the form of locating blisters 28 along the rear edge of the top of cabinet 12 for securely locating a second type amenity unit such as the illustrated upright paper tray 30. Unit 12 is uniquely constructed to fit under worksurface 20 without the need to remove paper tray 30 placed thereon, thus further facilitating use. Cabinet 12 further includes a laterally extending recess or inverted step 32 located at its lower rear edge which adds to the aesthetics of mobile unit 10 and also can provide clearance for baseboard type interferences such as electrical receptacles and electrical plugs (not shown) located along a wall or partition panel 21.

Cabinet 12 includes side panels 34, 36, a front panel 38, a rear panel 40, a top panel 42 and a bottom panel 44 which define an internal compartment or hollow interior 14. Panels 34–44 are rigidly interconnected to form a stable structure and can be made of any of a number of materials such as metal, wood, plastic and the like.

Front panel 38 includes an enlarged opening for receiving drawer 16, drawer 16 being mateably sized to fit within internal compartment 14 and through the opening in front panel 38. Drawer 16 rides fore-to-aft on a guide means or track (not shown) which is mounted within internal compartment 14. Front panel 38 further includes an upper front member 46 which mounts over drawer 16 and defines a maximum height for the contents of drawer 16 as drawer 16 is moved in and out. Front member 46 adds to the aesthetics of mobile unit 10, however, it is contemplated that mobile cabinet 10 could function acceptably without a front member 46.

Top 42 (FIG. 2) is specially adapted to receive two different types of amenity units or trays which allow cabinet 10 to be adapted for different uses and also to personalize the cabinet. The first adaptation includes a recess or recessed area 24 which is generally centrally located on top 42 and toward the front of mobile cabinet 10. Recessed area 24 includes a lip 48 around its perimeter that defines a top marginal edge, and a downwardly extending pocket portion 50. Pocket portion 50 is deep enough to receive trays 26 as discussed below, but shallow enough to prevent an interference with the contents of drawer 16 as drawer 16 is opened. It is contemplated that recessed area 24 could be merely an aperture in top 42, but the preferred embodiment includes a pocket portion 50 to prevent unauthorized access to hollow interior 14.

Top 42 (FIG. 2) further includes protruding blisters 28 along its rear edge for securely locating upright trays 30. Three spaced blisters 28 are shown, but it is anticipated that any number or spacing could be used. Blisters 28 are semi-spherical in shape and extend upwardly from top panel 42. Though semi-spherically shaped blisters are shown, blisters 28 could be any of a number of different shapes and still adequately perform their function of stability locating trays 30.

Near the rear lower area of mobile unit 10 is a recess or inverted step 32 which extends laterally the width of cabinet 12. Step 32 has a generally rectangular cross-section and adapts mobile unit 10 to roll abuttingly against a floor track 52 or wall 21 while simultaneously clearing a baseboard type interference on wall 21. For example, step 32 allows mobile unit 10 to clear an electrical cord (not shown) plugged into an electrical outlet or receptacle in floor track 52. In the preferred embodiment step 32 is small enough that rear panel 40 abuts a floor track 52 (FIG. 2), although it is contemplated that step 26 could be made larger.

Wheels 18 of mobile unit 10 ar positioned slightly forward of inverted step 32 to provide clearance for electrical power receptacles mounted in floor track 52. Step 32 can be continuous in cross-sectional shape, or, as shown, somewhat convex in shape from side to side. The convex shape adds strength and aesthetics to the rear of cabinet 12 near where castors 18 attach and also allows mobile unit 10 to clear baseboard level interferences as previously noted.

As mentioned, drawer 16 (FIG. 2) is movably mounted within cabinet 12 on guide means through an opening in front panel 38. Drawer 16 mateably closes flush under front member 46 to provide an aesthetically pleasing appearance. Drawer 16 includes a handle 54 and lock 56 to facilitate access to and security for drawer 16. Handle 54 and lock 56 can be located anywhere, but are shown as centered on drawer 16 and adjacent front member 46 of front panel 38.

Figure 3:
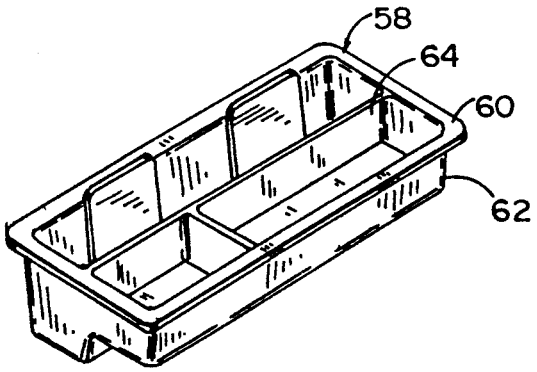
FIG. 3 is a second embodiment of the recessed tray.

A first set of amenity units or recessed trays are illustrated by tray 26 (FIGS. 1-2) and tray 58 (FIG. 3). Tray 26 (FIG. 2) includes an outer portion or lip 60 which is shaped to mateably engage perimeter lip 48 of recessed area 28. Outer portion 60 (FIG. 3) matingly rests on recess perimeter lip 48, and also includes a downwardly extending wall section 62 that fits within perimeter lip 48 and pocket portion 50 of recessed area 24. In the preferred embodiment, tray 26 (and 58) merely set within recessed area 28, but it is contemplated that downwardly extending wall section 62 could optionally include detents or interference means to securely hold tray 26 (and 58) within recessed area 24.

The inner pocket portion 50 of the amenity units which fit within recessed area 24 are designed with various recesses and wall sections to satisfy various uses and desires of users. For example, tray 26 (FIG. 1) provides a generally open pocket for holding such items as pencils, pens, glasses and also larger personal effects. Alternatively, tray 58 (FIG. 3) includes various dividers 64 defining multiple bins or receptacles such as for holding paper clips, small paper pads, computer disks and the like.

A second set of upstanding amenity units illustrated by paper tray 30 is provided for resting on top panel 42 at the rear of mobile cabinet 10. The illustrated tray 30 (FIG. 2) includes a base member 68 with multiple downwardly oriented apertures 66 which mateably and snugly engage locating blisters 28 to provide secure and stable location for tray 30 on cabinet 12. Tray 30 is a two tier mail in/out box with rear stand member 72 upstanding from base member 68 and shelf member 74 horizontally attached thereto. Side members 70 are located on either side of base member 68 and shelf member 74 thus forming two receptacles for receiving mail or other documents. It is contemplated that upstanding amenity units like tray 30 will be designed to be installable in a centered position on cabinet 12, though alternative arrangements are possible. It is also specifically contemplated that tray 30 can be moved between worksurface 20 and mobile unit 10.

Mobile storage unit 10 is particularly adapted for use in conjunction with a unit modular furniture arrangement marketed by Steelcase, Inc., assignee of the present application, under the "Context" trademark, which system is disclosed in related U.S. Pat. No. 5,092,253 issued Mar. 3, 1992, to Grund et al. entitled MODULAR FURNITURE, the entire contents of which are incorporated hereinafter by reference. In general, the "Context" modular furniture comprises a freestanding furniture arrangement having an amenity mounting rail system which extends continuously along the rearward edge of a worksurface panel. The "Context" amenity units include downwardly extending standoff pins which engage the "Context" mounting rail system, but are removable and allow the amenity units to be used without the standoff pins, is free standing on a worksurface. The holes exposed by removing the standoff pins matingly receive the blisters thereby locating the amenity units in position on cabinet 10. Also, the "Context" worksurface panel is spacially supported above the floor supporting surface leaving an open area thereunder for receiving accessories such as the present mobile storage unit 10.

The "Context" furniture is, in turn, particularly adapted for use with a floor track which is designed to carry utilities from workstation to workstation. A floor track system is fully described in co-pending U.S. Pat. application Ser. No. 07/307,691, filed Feb. 7, 1989 (now U.S. Pat. No. 5,152,698, issued Oct. 6, 1992), by Applicant Juhlin and entitled: FLOOR TRACK SYSTEM FOR OFFICE FURNITURE AND THE LIKE, the contents of which are incorporated herein by reference. Floor track 52 is contemplated to be generally rectangular in cross-section and positioned on a supporting floor.

Mobile unit 10 can be used in a work environment in the following manner. An operator initially decides and selects a recessed tray 26 and upright tray 30 which would be most satisfactory to the operator in terms of function and personalization. The operator then places trays 26 and 30 on mobile unit 10 and locates unit 10 adjacent the operator's desk or workstation 22. Mobile unit 10 can be moved to an optimum location depending on the operators task at any given time.

When a user desires to store mobile unit 10, the user merely positions mobile unit 10 under worksurface 20. Tray 30 can be moved onto worksurface 20 if desired or merely left on top 42 of mobile unit 10.

If a new operator begins using mobile unit 10, or if a job function changes or a new look is desired for personal reasons, an operator simply replaces units 26 and 30 to create a substantially new look and functional arrangement.

Thus a mobile storage unit or cabinet with drawer and wheels is provided with a recessed area for receiving recessed trays and a locating feature for upstanding trays. The unit further includes a laterally extending inverted step located at the lower edge of the cabinet to facilitate mateably engaging a wall and avoiding a baseboard type interference.

In the foregoing discussion it will be readily appreciated by those skilled in the art that modifications may be made to the invention without departing from the concepts disclosed herein. Such modifications are to be considered as included in the following claims unless these claims by there language expressly state otherwise.

The embodiments of the invention in which an exclusive property or privilege is claimed are defined as follows:

1. A mobile storage unit for office workstations, and the like, comprising:

a cabinet having a rigid exterior and a hollow interior shaped to receive and store objects therein, said cabinet including a top with an upper surface thereof positioned to be received underneath a worksurface of an associated workstation for storage;

a drawer slideably mounted in said cabinet for fore-to-aft movement therein to selectively access the interior of said cabinet;

means for movably supporting said cabinet on a floor surface to enable said storage unit to be readily manually translated over the floor surface between remote work area;

a recess positioned in the top of said cabinet, and extending through the upper surface thereof to define a top marginal edge;

a plurality of amenity trays, each having means for equipping the associated workstation, at least one of said amenity trays being shaped to be individually dropped into said recess, and be removable supported in a hanging fashion from the marginal edge of said recess to personalize said storage unit for selected tasks;

means for locating located along the width of said top and near a rear edge thereof; and at least one of said amenity trays being of a second type having a lower end thereof with means for engaging said means for locating in said top, said second type amenity tray further having an upper and thereof with means for equipping said cabinet, said means for engaging being shaped to closely engage said means for locating in said top to securely yet removably locate said one second type amenity tray, whereby one or more of said second type amenity trays can be arranged and detachably located on said top along said rear edge of said to personalize said cabinet.

2. The mobile storage unit as defined in claim 1 wherein said means for locating includes a plurality substantially identical blisters placed generally regularly along the width of said top.

3. A mobile storage unit as defined by claim 2 wherein said mobile storage unit is adapted to mateably fit under said worksurface with said one second type amenity tray still in place thereon.

4. A mobile storage unit for office workstations, and the like, comprising:

a cabinet having a rigid exterior and a hollow interior shaped to receive and store objects therein, said cabinet including a fixed top with a rear edge and an upper surface thereof positioned to be closely received underneath a worksurface of an associated workstation for storage;

a drawer slideably mounted in said cabinet for fore-to-aft movement therein to selectively access the interior of said cabinet;

means for movably supporting said cabinet on a floor surface to enable said storage unit to be readily manually translated over the floor surface between remote work areas;

means for locating located generally along said rear edge of said top; and an amenity tray positionable on said means for locating on said top in a continuously exposed position so that said amenity tray is readily accessible, said amenity tray having a lower end thereof with means for engaging said means for locating in said top, and an upper end thereof with means equipping said cabinet, said upper end rising only a predetermined distance above said top when said amenity tray is placed on said top so that said cabinet can be positioned underneath the worksurface without removing said amenity tray from said top; said means for engaging being shaped to closely engage said means for locating in said top to securely yet removably locate said amenity tray, whereby said amenity tray can be arranged and detachably located on said top along said rear edge of said top to personalize said cabinet and also to equip a particular workstation as desired.

5. The mobile storage unit as defined in claim 4 wherein said means for locating includes upwardly extending shaped blisters.

6. A mobile storage unit for office workstations, and the like, comprising:

a cabinet having a rigid exterior and a hollow interior shaped to receive and store objects therein, said cabinet including a top with a rear edge and an upper surface thereof positioned to be closely received underneath a worksurface of an associated workstation for storage;

a drawer slideably mounted in said cabinet for fore-to-aft movement therein to selectively access the interior of said cabinet;

means for movably supporting said cabinet on a floor surface to enable said storage unit to be readily manually translated over the floor surface between remote work areas;

means for locating located generally along said rear edge of said top;

an amenity tray having a lower end thereof with means for engaging said means for locating in said top, and an upper end thereof with means for equipping said cabinet, said means for engaging being shaped to closely engage said means for locating in said top to securely yet removable locate said amenity tray, whereby said amenity tray can be arranged and detachably located on said top along said rear edge of said top to personalize said cabinet;

said means for locating including upwardly extending spherically-shaped blisters and said means for engaging including apertures sized to closely receive said blisters and to provide lateral support to said amenity trays and to prevent lateral movement of said amenity tray.

7. A mobile storage unit as defined in claim 6 wherein said mobile storage unit is adapted to mateably fit under said worksurface with said amenity tray still in place thereon.

8. The system of office furniture as defined in claim 7 wherein said mobile storage unit includes an inverted step located at the bottom and rear of said cabinet and extending laterally therealong.

9. The mobile storage unit as defined in claim 4 wherein said amenity tray is an upright paper tray.

* * * * *